US010508449B2

(12) United States Patent
Elizondo et al.

(10) Patent No.: US 10,508,449 B2
(45) Date of Patent: Dec. 17, 2019

(54) GUTTER ASSEMBLY UTILIZING A LATCH ACTUATED BOTTOM DEBRIS RELEASE DOOR

(71) Applicants: Eric William Elizondo, Charlotte, NC (US); John Nikolai Sharpe, Charlotte, NC (US)

(72) Inventors: Eric William Elizondo, Charlotte, NC (US); John Nikolai Sharpe, Charlotte, NC (US)

( * ) Notice: Subject to any disclaimer, the term of this patent is extended or adjusted under 35 U.S.C. 154(b) by 0 days.

(21) Appl. No.: 16/164,913

(22) Filed: Oct. 19, 2018

(65) Prior Publication Data

US 2019/0119919 A1 Apr. 25, 2019

Related U.S. Application Data

(60) Provisional application No. 62/574,278, filed on Oct. 19, 2017.

(51) Int. Cl.

| | |
|---|---|
| ***E04D 13/076*** | (2006.01) |
| ***E04D 13/068*** | (2006.01) |
| ***E04D 13/064*** | (2006.01) |
| *E04D 13/08* | (2006.01) |

(52) U.S. Cl.

CPC ..... *E04D 13/076* (2013.01); *E04D 13/068* (2013.01); *E04D 13/0641* (2013.01); *E04D 2013/0866* (2013.01)

(58) Field of Classification Search

CPC . E04D 13/068; E04D 13/0641; E04D 13/064; E04D 13/076; E04D 2013/0866

See application file for complete search history.

(56) References Cited

U.S. PATENT DOCUMENTS

| | | | | | |
|---|---|---|---|---|---|
| 1,653,473 | A | * | 12/1927 | Schulz | B01D 35/28 210/130 |
| 3,630,473 | A | * | 12/1971 | Landis | E04D 13/076 248/222.51 |
| 4,199,121 | A | * | 4/1980 | Le Febvre | E04D 13/076 248/202.1 |
| 4,407,097 | A | * | 10/1983 | Allen | E04D 13/076 52/11 |
| 4,413,449 | A | * | 11/1983 | Faye | E04D 13/076 16/223 |

(Continued)

FOREIGN PATENT DOCUMENTS

| | | | | |
|---|---|---|---|---|
| CA | 2940385 | A1 * | 2/2017 | E04D 13/0765 |

*Primary Examiner* — Jessie T Fonseca

(74) *Attorney, Agent, or Firm* — Clements Bernard Walker PLLC; Christopher L. Bernard

(57) ABSTRACT

A gutter assembly utilizing a latch actuated bottom release door. This bottom debris release door allows built-up debris, snow, and the like to be quickly and effectively removed from the gutter such that conventional clearing and cleaning methodologies are not necessary. The latch mechanism utilized can be conveniently actuated from the ground using an extension pole or the like. Optionally, an electronic release mechanism can be provided. The gutter assembly of the present invention can be used with a variety of conventional or custom bracings, end caps, downspouts, connectors, corner pieces, etc., well known to those of ordinary skill in the art, and can be installed like any conventional gutter. All components of the gutter assembly can be extruded, molded, three-dimensional (3-D) printed, or the like.

20 Claims, 6 Drawing Sheets

(56) References Cited

U.S. PATENT DOCUMENTS

| | | | | | |
|---|---|---|---|---|---|
| 4,446,658 | A * | 5/1984 | Gouin | E04D 13/076 | 405/119 |
| 4,998,386 | A * | 3/1991 | Baumgarth | E04D 13/064 | 52/11 |
| 5,216,852 | A * | 6/1993 | Bemis | E04D 13/064 | 248/48.1 |
| 5,268,969 | A * | 12/1993 | Duran, Jr. | B65D 33/14 | 220/495.06 |
| 5,274,965 | A * | 1/1994 | Jackson | E04D 13/076 | 16/389 |
| 5,417,015 | A * | 5/1995 | Coyne | E04D 13/076 | 16/382 |
| 5,638,643 | A * | 6/1997 | Demartini | E04D 13/064 | 52/11 |
| 5,649,681 | A * | 7/1997 | Faye | E04D 13/076 | 248/292.13 |
| 6,964,135 | B1 * | 11/2005 | Slodov | E04D 13/0765 | 52/11 |
| D777,302 | S * | 1/2017 | Bice, Jr. | D23/267 | |
| 9,874,019 | B1 * | 1/2018 | Bice, Jr. | E04D 13/076 | |
| D815,258 | S * | 4/2018 | Bienek | D23/267 | |
| 2004/0031209 | A1 * | 2/2004 | Porter | E04D 13/0645 | 52/12 |
| 2006/0137258 | A1 * | 6/2006 | Crossley | E04D 13/0641 | 52/12 |
| 2007/0125005 | A1 * | 6/2007 | Carson | E04D 13/076 | 52/11 |
| 2012/0144607 | A1 * | 6/2012 | Johnson | E04D 13/064 | 15/104.05 |
| 2013/0283707 | A1 * | 10/2013 | Ratajac | E04D 13/076 | 52/12 |
| 2016/0348373 | A1 * | 12/2016 | Merrill | E04D 13/076 | |

* cited by examiner

GUTTER ASSEMBLY UTILIZING A LATCH ACTUATED BOTTOM DEBRIS RELEASE DOOR

CROSS-REFERENCE TO RELATED APPLICATION

The present patent application/patent claims the benefit of priority of U.S. Provisional Patent Application No. 62/574,278, filed on Oct. 19, 2017, and entitled "GUTTER ASSEMBLY UTILIZING A TOUCH LATCH ACTUATED BOTTOM DEBRIS RELEASE DOOR," the contents of which are incorporated in full by reference herein.

FIELD OF THE INVENTION

The present invention relates generally to the gutter field. More specifically, the present invention relates to a gutter assembly utilizing a latch actuated bottom debris release door. This bottom debris release door allows built-up debris, snow, and the like to be quickly and effectively removed from the gutter such that conventional clearing and cleaning methodologies are not necessary.

BACKGROUND OF THE INVENTION

Conventional gutters are prone to the accumulation of leaves and other debris, snow, and the like. Such clogs decrease their effectiveness, blocking the flow of water through the gutters and causing it to undesirably backup and pool. This can ultimately lead to roof and wall damage of the associated structures. There are a number of known mechanisms for combating this problem, all of which are only marginally effective. Some gutters are equipped with slotted caps or screens that prevent the debris or snow from entering the gutters in the first place. These solutions, however, undesirably limit the water flow volume into the gutters and can themselves be prone to clogging. Other gutters are pivotably attached to the associated structures, such that the top openings can be rotated outward and downward from the associated structures to a degree, thereby theoretically making cleaning easier. This solution, however, requires the use of complex and unsightly hinge mechanisms, as well as adequate actuation space adjacent to the structures. As a result, most gutter clearing and cleaning is still done manually, using a ladder and broom or leaf blower, or an expensive ground based gutter vacuum utilizing a gutter cleaning extension.

Thus, what is still needed in the art is an improved gutter assembly that allows built-up debris, snow, and the like to be quickly and effectively removed from the gutter such that conventional clearing and cleaning methodologies are not necessary.

BRIEF SUMMARY OF THE INVENTION

In various exemplary embodiments, the present invention provides a gutter assembly utilizing a latch actuated bottom release door. This bottom debris release door allows built-up debris, snow, and the like to be quickly and effectively removed from the gutter such that conventional clearing and cleaning methodologies are not necessary. The latch mechanism utilized can be conveniently actuated from the ground using an extension pole or the like. Optionally, an electronic release mechanism can be provided. The gutter assembly of the present invention can be used with a variety of conventional bracings, end caps, downspouts, connectors, corner pieces, etc., well known to those of ordinary skill in the art, and can be installed like any conventional gutter. All components of the gutter assembly can be extruded, molded, three-dimensional (3-D) printed, or the like. The gutter assembly saves time and effort, as debris merely drops to the ground when the bottom debris release door is actuated.

In one exemplary embodiment, the present invention provides gutter assembly, comprising: a gutter body comprising a rear portion, a bottom portion, a front portion, and a top portion, wherein the rear portion of the gutter body comprises a rear wall member, the front portion of the gutter body comprises a front wall member, and the top portion is open such that water, debris, and/or snow can pass into the gutter body; and a door member hingedly disposed in one or more of all or a portion of the bottom portion of the gutter body and a portion of the front portion of the gutter body; wherein the door member is configured to be opened such that the debris and/or snow are released from the gutter body. The gutter assembly further comprises a hinge mechanism operable for hingedly coupling the door member to one or more of the wall member of the rear portion of the gutter body and the bottom portion of the gutter body. The gutter assembly further comprises a latch mechanism coupled to the front wall member of the front portion of the gutter body, wherein the latch mechanism is operable for engaging a portion of the door member opposite the hinge mechanism and holding the door member in a closed configuration such that the water, debris, and/or snow are retained by the gutter body. Optionally, the rear wall member forms substantially all of the rear portion of the gutter body. Optionally, the door member forms substantially all of the bottom portion of the gutter body. Optionally, the front wall member forms a portion of the front portion of the gutter body and the door member forms a remaining portion of the front portion of the gutter body. Optionally, the hinge mechanism comprises a sealing flexure disposed between the rear wall member of the rear portion of the gutter body and a rear portion of the door member. Optionally, the gutter assembly further comprises a sealing member disposed between the front wall member of the front portion of the gutter body and a front portion of the door member. Optionally, a retention member of the latch mechanism is biased towards the door member and engages a lip structure coupled to the door member. Optionally, the gutter assembly further comprises a waste bag coupled to the gutter body adjacent to the door member and configured to catch the debris and/or snow released from the gutter body when the door member is opened.

In another exemplary embodiment, the present invention provides a method for providing a gutter assembly, comprising: providing a gutter body comprising a rear portion, a bottom portion, a front portion, and a top portion, wherein the rear portion of the gutter body comprises a rear wall member, the front portion of the gutter body comprises a front wall member, and the top portion is open such that water, debris, and/or snow can pass into the gutter body; and providing a door member hingedly disposed in one or more of all or a portion of the bottom portion of the gutter body and a portion of the front portion of the gutter body; wherein the door member is configured to be opened such that the debris and/or snow are released from the gutter body. The method for providing the gutter assembly further comprises providing a hinge mechanism operable for hingedly coupling the door member to one or more of the wall member of the rear portion of the gutter body and the bottom portion of the gutter body. The method for providing the gutter assembly further comprises providing a latch mechanism coupled to the front wall member of the front portion of the gutter body, wherein the latch mechanism is operable for engaging a portion of the door member opposite the hinge mechanism and holding the door member in a closed configuration such that the water, debris, and/or snow are retained by the gutter body. Optionally, the rear wall member forms substantially all of the rear portion of the gutter body. Optionally, the door member forms substantially all of the bottom portion of the gutter body. Optionally, the front wall member forms a portion of the front portion of the gutter body and the door member forms a remaining portion of the front portion of the gutter body. Optionally, the hinge mechanism comprises a sealing flexure disposed between the rear wall member of the rear portion of the gutter body and a rear portion of the door member. Optionally, the method for providing the gutter assembly further comprises providing a sealing member disposed between the front wall member of the front portion of the gutter body and a front portion of the door member. Optionally, a retention member of the latch mechanism is biased towards the door member and engages a lip structure coupled to the door member. Optionally, the method for providing the gutter assembly further comprises providing a waste bag coupled to the gutter body adjacent to the door member and configured to catch the debris and/or snow released from the gutter body when the door member is opened.

BRIEF DESCRIPTION OF THE DRAWINGS

The present invention is illustrated and described herein with reference to the various drawings, in which like reference numbers are used to denote like assembly components/method steps, as appropriate, and in which.

DETAILED DESCRIPTION OF THE INVENTION

Again, the present invention provides a gutter assembly utilizing a latch actuated bottom release door. This bottom debris release door allows built-up debris, snow, and the like to be quickly and effectively removed from the gutter such that conventional clearing and cleaning methodologies are not necessary. The latch mechanism utilized can be conveniently actuated from the ground using an extension pole or the like. Optionally, an electronic release mechanism can be provided. The gutter assembly of the present invention can be used with a variety of conventional or custom bracings, end caps, downspouts, connectors, corner pieces, etc., well known to those of ordinary skill in the art, and can be installed like any conventional gutter. All components of the gutter assembly can be extruded, molded, 3-D printed, or the like.

Figure 1:
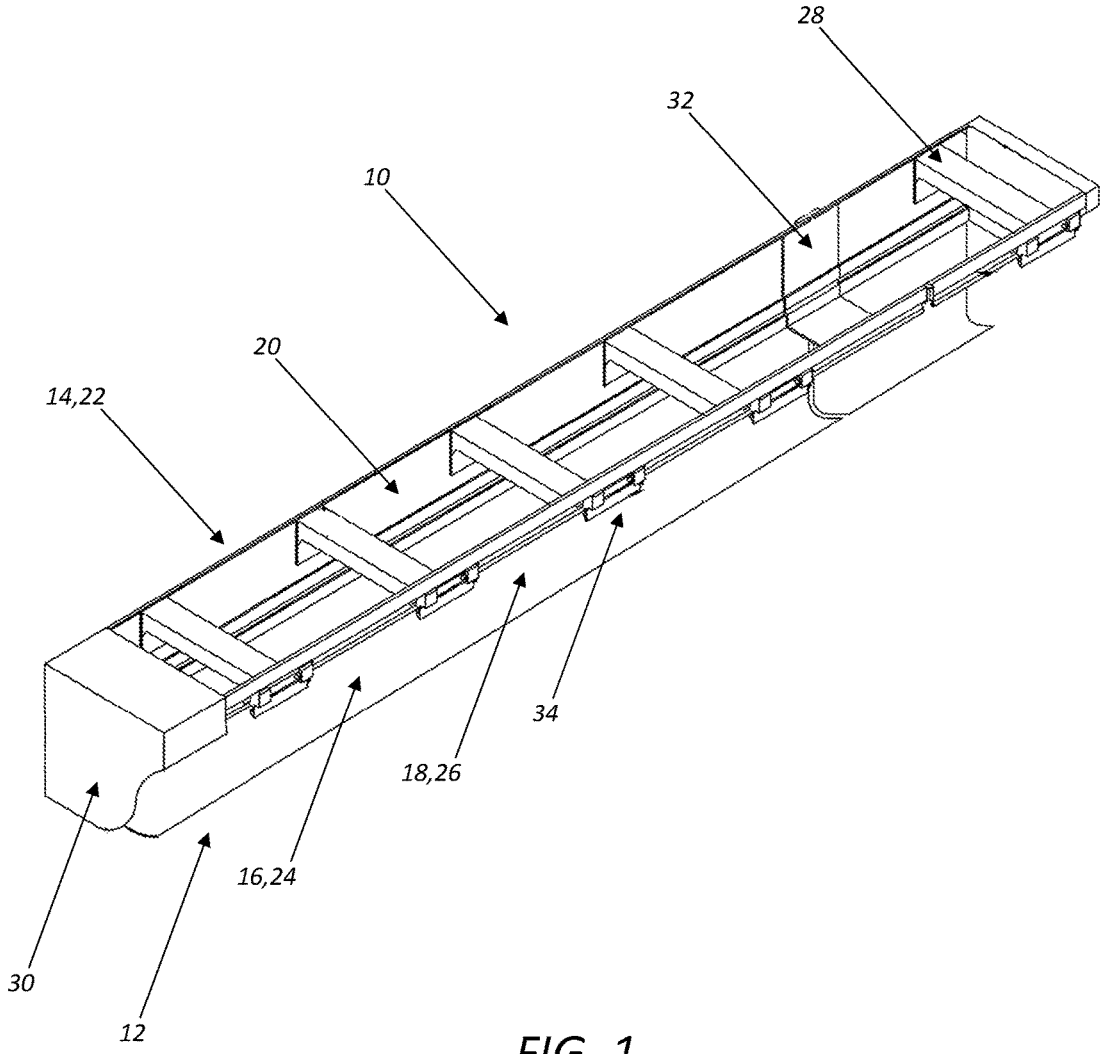
FIG. 1 is a perspective view of one exemplary embodiment of the gutter assembly of the present invention with the bottom debris release doors in a deployed configuration.

Referring now specifically to FIG. 1, in one exemplary embodiment of the present invention, the gutter assembly 10 includes a gutter body 12 including a rear portion 14, a bottom portion 16, a front portion 18, and a top portion 20. In the embodiment illustrated, the rear portion 14 of the gutter body 12 includes a coextensive rear wall member 22 that is configured to be disposed adjacent to the wall of a structure just below the roof line, for example. The bottom portion 16 of the gutter body 12 includes a deployable door member 24. This door member 24 can form all or a portion of the bottom portion 16 of the gutter body 12. It should be noted that the door member 24 can extend the length of the bottom portion 16 of the gutter body 12, or discrete door members 24 can be spaced periodically along the bottom portion 16 of the gutter body 12, with conventional bottom wall members disposed in between. The front portion 18 of the gutter body 12 includes a front wall member 26 that can form all or only a part of the front portion 18 of the gutter body 12. In the latter case, the remaining portion of the front portion 18 of the gutter body 12 is formed by the door member 24, with the door member 24 having both outward and upward protruding portions. The top portion 20 of the gutter body is generally open, such that water, debris, and/or snow can readily flow into the gutter body 12 when in use. In this sense, the gutter body 12 is sized and shaped like a conventional gutter. The gutter body 12 can be made of similar materials (e.g., thin plastic or aluminum), using similar manufacturing techniques (e.g., extrusion, molding, or 3-D printing). The gutter body 12 generally forms an upward facing U-shaped channel that is disposed adjacent to the wall of a structure just below the roof line such that it can catch runoff from the roof. Each of the wall members 22 and 26 and the door member 24 can have any suitable profile that enhances both functionality and appearance, including one or more straight seconds, concave sections, and/or convex sections.

The gutter body 12 can utilize any conventional or custom bracing mechanisms 28 that are designed to both hang the gutter assembly 10 on the side/roof of a structure and maintain separation between the rear wall member 22 and the front wall member 26 of the gutter body 12 near the top portion 20 thereof, as well as any conventional or custom end caps 30, downspouts, connectors 32, corner fittings, T-fittings, and/or the like. Such corner fittings and/or T-fittings could also incorporate the door members 24 of the present invention.

The door member(s) 24 of the present invention are held closed and released by one or more latch mechanisms 34 that are selectively actuated by a user. It will be readily apparent to those of ordinary skill in the art that the one or more latch mechanisms 34 can include any suitable retention/release mechanisms, such as mechanical mechanisms, electromechanical mechanisms, electronic mechanisms, etc. In this manner, each door member 24 allows built-up debris, snow, and the like to be quickly and effectively removed from the gutter body 12 such that conventional clearing and cleaning methodologies are not necessary. Preferably, the latch mechanism 34 utilized can be conveniently actuated from the ground using an extension pole or the like. Optionally, an electronic release mechanism can be provided such that a switch or remote control can be used to release the door member(s) 24 when it is desired to clear the gutter assembly 10 or avoid a heavy accumulation of snow, for example.

Figure 2:
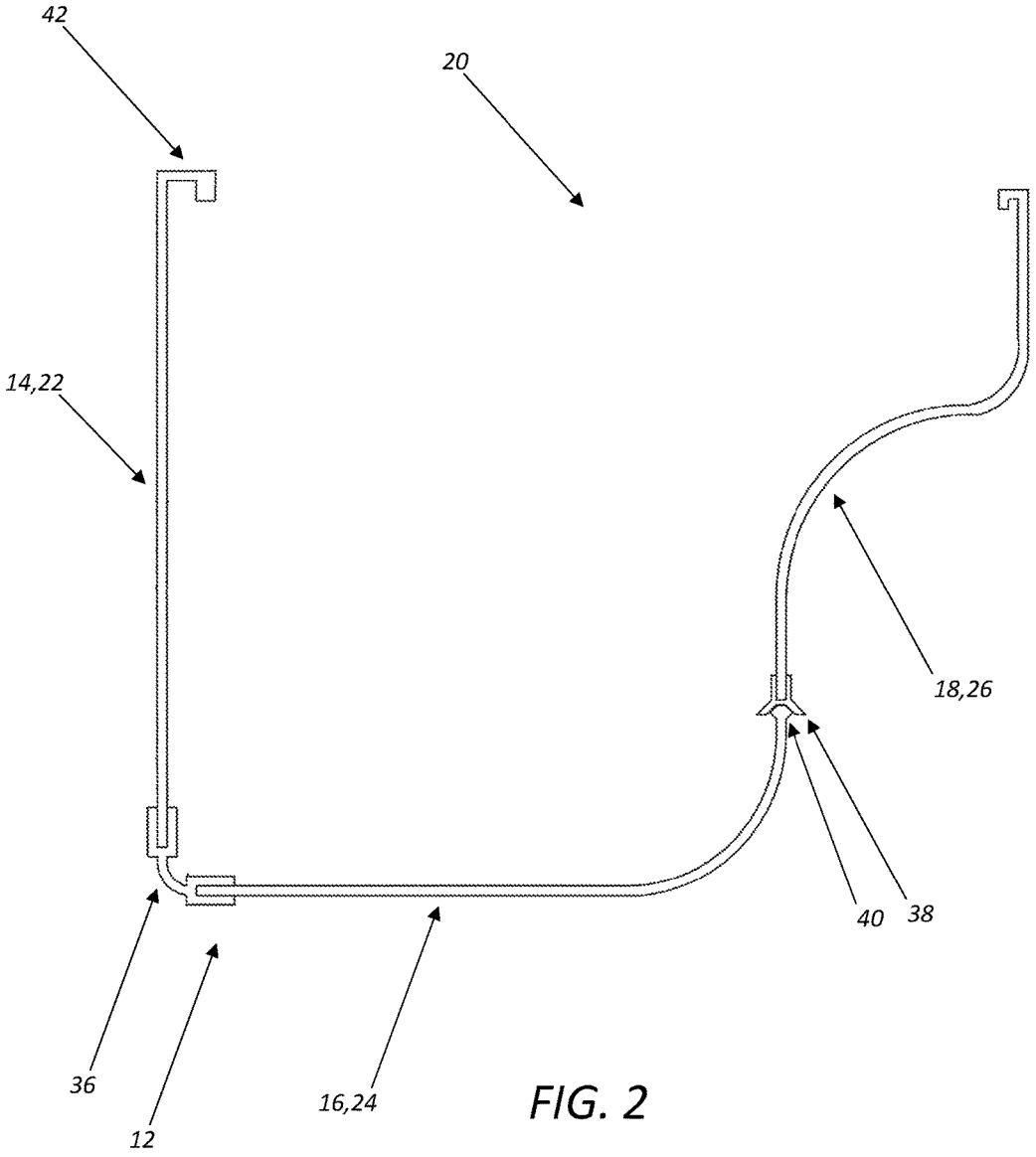
FIG. 2 is a cross-sectional end view of one exemplary embodiment of the gutter assembly of the present invention (absent the latch mechanism) with the bottom debris release door in a closed configuration, highlighting the position and function of the hinge and closure members.
Figure 3:
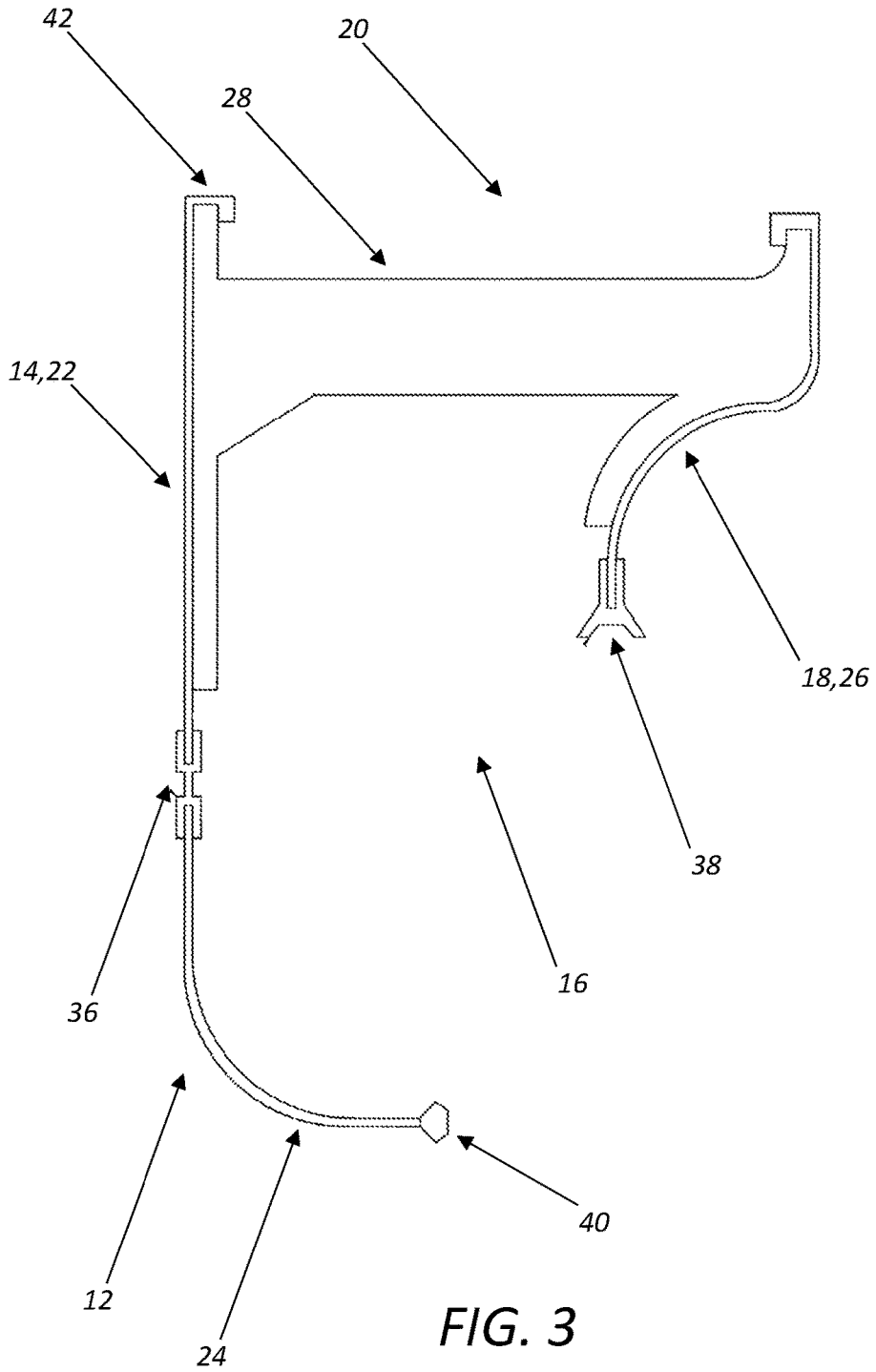
FIG. 3 is a cross-sectional end view of one exemplary embodiment of the gutter assembly of the present invention (absent the latch mechanism and including a bracing member) with the bottom debris release door in the deployed configuration, again highlighting the position and function of the hinge and closure members.

FIG. 2 is a cross-sectional end view of one exemplary embodiment of the gutter body 12 of the present invention (absent the latch mechanism 34 (FIG. 1)) with the bottom door member 24 in a closed configuration, highlighting the position and function of the hinge 36 and closure 38 members. FIG. 3 is a cross-sectional end view of the same exemplary embodiment of the gutter body 12 of the present invention (absent the latch mechanism 34 and including a bracing member 28) with the bottom door member 24 in a deployed configuration, again highlighting the position and function of the hinge 36 and sealing closure 38 members. Optionally, the hinge member 36 includes a resilient, sealing fitting or flexure attached to a lower end of the rear wall member 22 and a rear end of the door member 24 that is configured to allow the door member 24 to pivot downwards when released by the latch mechanism 34 by the force of gravity and the weight of the contents of the gutter body 12. It will be readily apparent to those of ordinary skill in the art that any other suitable mechanical or integral hinge mechanism could be used equally. Optionally, the sealing closure member 38 includes a resilient, sealing fitting attached to a lower end of the front wall member 26 and a front end (or top edge) of the door member 24 that is configured to allow the door member 24 to sealingly engage the front wall member 26 when retained by the latch mechanism 34. In this exemplary embodiment, the door member 24 includes a widened end boss 40 at the front end thereof for this purpose. It will be readily apparent to those of ordinary skill in the art that any other suitable mechanical or integral coupling mechanism could be used equally. As illustrated, the rear wall member 22 and the front wall member 26 can incorporate any desired flanges 42 or the like for attachment to the bracings 28 or the like.

Figure 4:
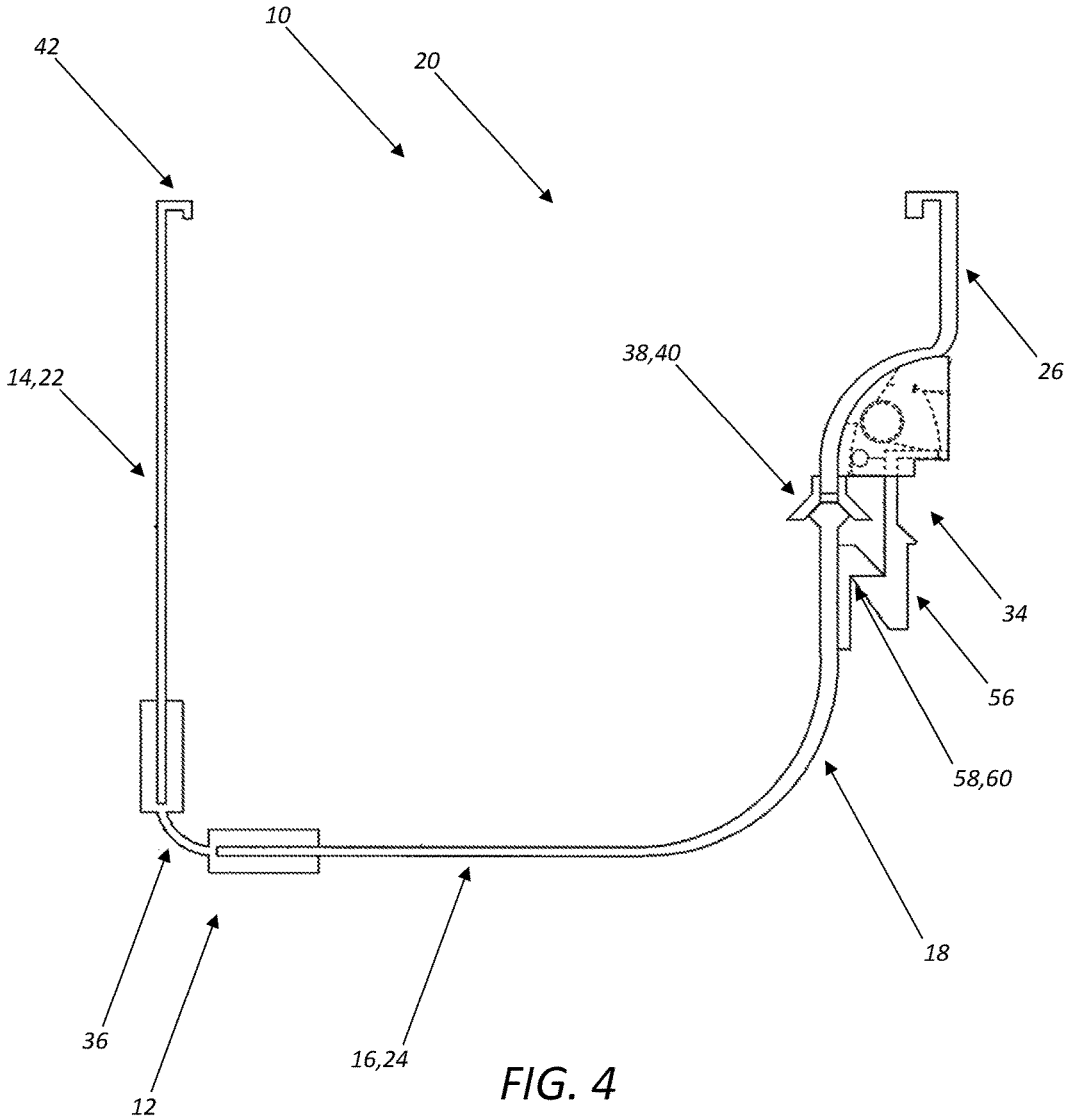
FIG. 4 is a cross-sectional end view of one exemplary embodiment of the gutter assembly of the present invention with the bottom debris release door in the closed configuration, highlighting the position and function of the hinge and closure members, as well as the latch mechanism.
Figure 5:
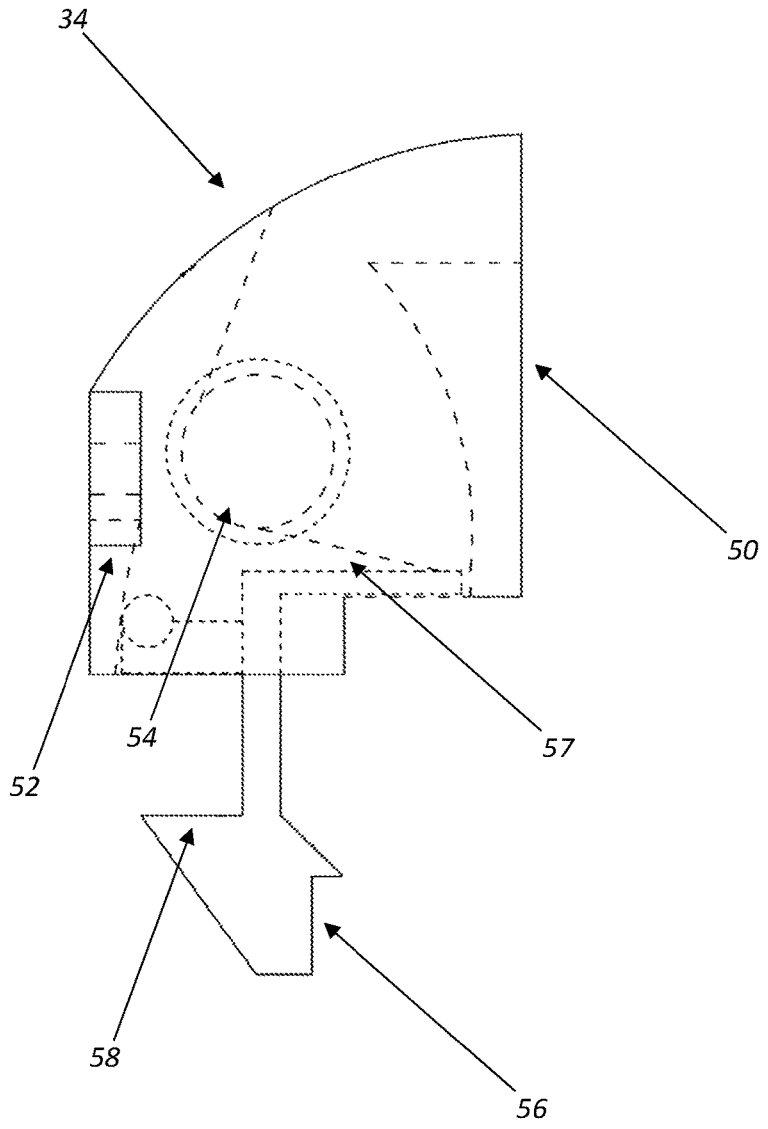
FIG. 5 is a cross-sectional end view of one exemplary embodiment of the latch mechanism of the present invention.
Figure 6:
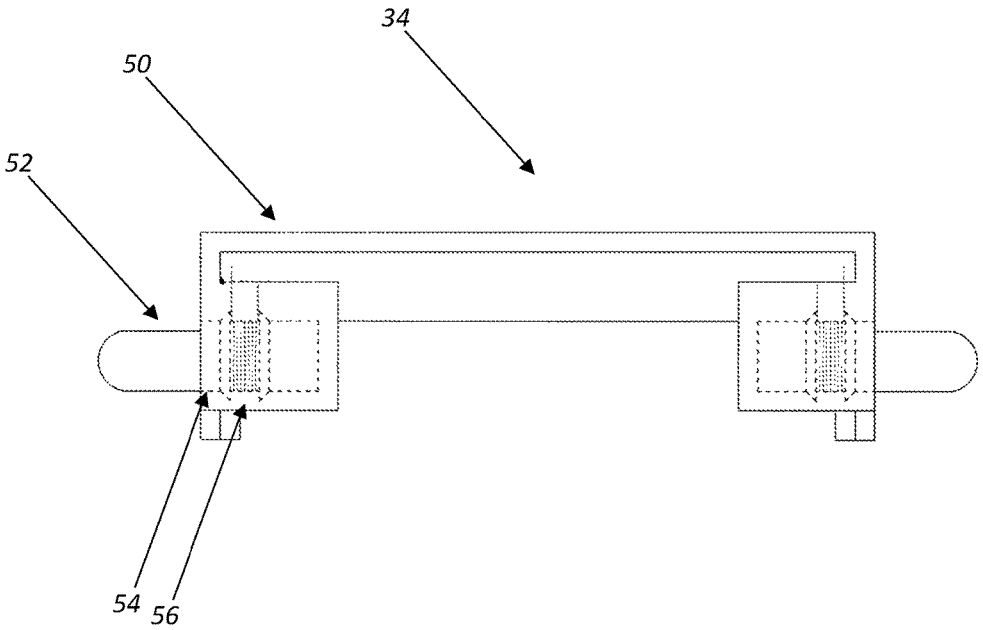
FIG. 6 is a cross-sectional side view of one exemplary embodiment of the latch mechanism of the present invention (absent the associated retention member).

Referring now specifically to FIGS. 4-6, in one exemplary embodiment of the present invention, the latch mechanism 34 includes a housing 50 that is coupled to the front wall member 26 of the gutter body 12, optionally via a plurality of attachment tabs 52 or the like. In this exemplary embodiment, the housing 50 is a conformal structure that partially nests into the contours of the front wall member 26. The interior of the housing 50 houses a post 54 and concentric spring member 57 or other suitable flexure mechanism that pivotably biases a pivoting or flexing retention member 56 that protrudes from the bottom of the housing 50. The retention mechanism 56 includes, for example, an elongate hook structure 58 that is configured to engage a corresponding hook structure 60 or recess coupled to or manufactured into the door member 24 when the door member 24 is closed, thereby securely holding the door member 24 shut. As alluded to herein above, the retention mechanism 56 can also engage the door member 24 itself or any widened or recessed portion thereof. It will be readily apparent to those of ordinary skill in the art that any suitable latch mechanism 34 or release can be used, provided that it adequately holds the door member 24 shut and allows it to be opened easily, preferably from the ground. By way of example, the latch mechanism 34 could consist of a simple snap closure or the like. Optionally, an electronic release mechanism can be provided.

Again, the present invention provides a gutter assembly utilizing a latch actuated bottom release door. This bottom debris release door allows built-up debris, snow, and the like to be quickly and effectively removed from the gutter such that conventional clearing and cleaning methodologies are not necessary. The latch mechanism utilized can be conveniently actuated from the ground using an extension pole or the like. Optionally, an electronic release mechanism can be provided. The gutter assembly of the present invention can be used with a variety of conventional or custom bracings, end caps, downspouts, connectors, corner pieces, etc., well known to those of ordinary skill in the art, and can be installed like any conventional gutter. All components of the gutter assembly can be extruded, molded, 3-D printed, or the like.

Referring again to FIGS. 1-4, optionally, the gutter assembly 10 further comprises a waste bag coupled to the gutter body 12 adjacent to the door member 24 and configured to catch the debris and/or snow released from the gutter body 12 when the door member 24 is opened.

Although the present invention is illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the present invention, are contemplated thereby, and are intended to be covered by the following non-limiting claims for all purposes.

What is claimed is:

1. A gutter assembly, comprising:

a gutter body comprising a rear portion, a bottom portion, a front portion, and a top portion, wherein the rear portion of the gutter body comprises a rear wall member, the front portion of the gutter body comprises a front wall member, and the top portion is open such that water, debris, and/or snow can pass into the gutter body;

a pivotable door member disposed in one or more of all or a portion of the bottom portion of the gutter body and a portion of the front portion of the gutter body;

a hinge mechanism coupled between the door member and the rear wall member of the rear portion of the gutter body; and a latch mechanism coupled to the front wall member of the front portion of the gutter body and operable for releasably engaging the door member;

wherein the door member is configured to be opened such that the debris and/or snow are released from the gutter body.

2. The gutter assembly of claim 1, wherein the hinge mechanism comprises a pivoting fitting or flexure operable for pivotably coupling the door member to one or more of the rear wall member of the rear portion of the gutter body and the bottom portion of the gutter body.

3. The gutter assembly of claim 2, wherein the latch mechanism comprises a releasable retainer operable for engaging a portion of the door member opposite the hinge mechanism and holding the door member in a closed configuration such that the water, debris, and/or snow are retained by the gutter body.

4. The gutter assembly of claim 1, wherein the rear wall member forms substantially all of the rear portion of the gutter body.

5. The gutter assembly of claim 1, wherein the door member forms substantially all of the bottom portion of the gutter body.

6. The gutter assembly of claim 1, wherein the front wall member forms a portion of the front portion of the gutter body and the door member forms a remaining portion of the front portion of the gutter body.

7. The gutter assembly of claim 2, wherein the hinge mechanism comprises a sealing flexure disposed between the rear wall member of the rear portion of the gutter body and a rear portion of the door member.

8. The gutter assembly of claim 2, further comprising a sealing fitting disposed between the front wall member of the front portion of the gutter body and a front portion of the door member.

9. The gutter assembly of claim 3, wherein a retention member of the latch mechanism is biased towards the door member and engages a lip structure coupled to the door member.

10. The gutter assembly of claim 3, wherein the latch mechanism comprises one of an electronically releasable retainer and an electromechanically releasable retainer.

11. A method for providing a gutter assembly, comprising:

providing a gutter body comprising a rear portion, a bottom portion, a front portion, and a top portion, wherein the rear portion of the gutter body comprises a rear wall member, the front portion of the gutter body comprises a front wall member, and the top portion is open such that water, debris, and/or snow can pass into the gutter body;

providing a pivotable door member disposed in one or more of all or a portion of the bottom portion of the gutter body and a portion of the front portion of the gutter body;

providing a hinge mechanism coupled between the door member and the rear wall member of the rear portion of the gutter body; and providing a latch mechanism coupled to the front wall member of the front portion of the gutter body and operable for releasably engaging the door member;

wherein the door member is configured to be opened such that the debris and/or snow are released from the gutter body.

12. The method for providing the gutter assembly of claim 11, wherein the hinge mechanism comprises a pivoting fitting or flexure operable for pivotably coupling the door member to one or more of the rear wall member of the rear portion of the gutter body and the bottom portion of the gutter body.

13. The method for providing the gutter assembly of claim 12, wherein the latch mechanism comprises a releasable retainer operable for engaging a portion of the door member opposite the hinge mechanism and holding the door member in a closed configuration such that the water, debris, and/or snow are retained by the gutter body.

14. The method for providing the gutter assembly of claim 11, wherein the rear wall member forms substantially all of the rear portion of the gutter body.

15. The method for providing the gutter assembly of claim 11, wherein the door member forms substantially all of the bottom portion of the gutter body.

16. The method for providing the gutter assembly of claim 11, wherein the front wall member forms a portion of the front portion of the gutter body and the door member forms a remaining portion of the front portion of the gutter body.

17. The method for providing the gutter assembly of claim 12, wherein the hinge mechanism comprises a sealing flexure disposed between the rear wall member of the rear portion of the gutter body and a rear portion of the door member.

18. The method for providing the gutter assembly of claim 12, further comprising providing a sealing fitting disposed between the front wall member of the front portion of the gutter body and a front portion of the door member.

19. The method for providing the gutter assembly of claim 13, wherein a retention member of the latch mechanism is biased towards the door member and engages a lip structure coupled to the door member.

20. The method for providing the gutter assembly of claim 13, wherein the latch mechanism comprises one of an electronically releasable retainer and an electromechanically releasable retainer.

* * * * *